US009581418B2

(12) United States Patent
Quail

(10) Patent No.: US 9,581,418 B2
(45) Date of Patent: Feb. 28, 2017

(54) ELECTRICAL SHOCKING SELF-DEFENSE TRAINING DEVICE

(71) Applicant: Jeffrey James Quail, Winnipeg (CA)

(72) Inventor: Jeffrey James Quail, Winnipeg (CA)

( * ) Notice: Subject to any disclaimer, the term of this patent is extended or adjusted under 35 U.S.C. 154(b) by 252 days.

(21) Appl. No.: 14/622,401

(22) Filed: Feb. 13, 2015

(65) Prior Publication Data

US 2016/0356578 A1 Dec. 8, 2016

Related U.S. Application Data

(60) Provisional application No. 61/939,709, filed on Feb. 13, 2014.

(51) Int. Cl.

| | |
|---|---|
| ***G07F 17/00*** | (2006.01) |
| ***F41H 13/00*** | (2006.01) |
| ***F41B 13/08*** | (2006.01) |
| ***H05C 1/00*** | (2006.01) |

(52) U.S. Cl.

CPC ..... *F41H 13/0018* (2013.01); *F41B 13/08* (2013.01); *H05C 1/00* (2013.01)

(58) Field of Classification Search

USPC ..... 463/47.2–47.6; 361/232

See application file for complete search history.

(56) References Cited

U.S. PATENT DOCUMENTS

| | | | | |
|---|---|---|---|---|
| 4,872,084 | A * | 10/1989 | Dunning | H05C 1/04 231/7 |
| 5,986,872 | A * | 11/1999 | Chaput | A45B 3/00 135/16 |
| 6,791,816 | B2 * | 9/2004 | Stethem | F21V 33/0076 231/7 |
| 7,353,984 | B2 | 4/2008 | Quail | |
| 9,162,129 | B2 * | 10/2015 | Horvath | A63B 69/00 |
| 2004/0264098 | A1 * | 12/2004 | Eccles | H05C 1/00 361/232 |
| 2006/0038002 | A1 * | 2/2006 | Quail | F41B 13/00 231/7 |

* cited by examiner

*Primary Examiner* — Ronald Laneau

(74) *Attorney, Agent, or Firm* — Ryan W. Dupuis; Kyle R. Satterthwaite; Ade & Company Inc.

(57) ABSTRACT

An edge weapon training device includes a handle body for gripping in a hand of a user and first and second contacts spaced apart at a first end of the handle body for delivering an electrical shock to a person being trained for self-defense against edge weapons when the handle body is thrust against the trainee in a simulated stabbing motion. In some instances a knife body protrudes beyond the contacts to visually represent a knife, but the knife body is supported to either retract into the handle body or be compressed against the handle body when the handle is thrust against a user in a simulated stabbing motion. Alternatively, the training device may take the form of a resilient adapter body which supports the contacts thereon and which can be supported over an existing stun gun with the contacts in connection to the electrical posts of the stun gun.

20 Claims, 8 Drawing Sheets

ELECTRICAL SHOCKING SELF-DEFENSE TRAINING DEVICE

This application which claims the benefit under 35 U.S.C. 119(e) of U.S. provisional application Ser. No. 61/939,709, filed Feb. 13, 2014.

FIELD OF THE INVENTION

The present invention relates a training device having a handle and a pair of electrical contacts at one end of the handle for delivering an electrical shock to a person being trained to defend themselves against edge weapons, for example police officers, correction officers, military soldiers, and civilians, when the handle is thrust against the person in a simulated knife stabbing motion. The present invention further relates to an attachment for converting a stun gun into a training device by covering the penetrating electrical posts of the stun gun with a guard supporting non-penetrating type electrical contacts thereon.

BACKGROUND

Various devices have been developed to train people to defend themselves against various edge weapons, for example knives and the like, in a safe and non-injurious manner for the trainee.

Typically, when individuals were training in self defense for edged weapon attacks, they utilized wooden, rubber or plastic knives. Utilizing these training aids lowers the possibility of injury during training.

Unfortunately, since rubber knives are not capable of causing injury or pain, they produce a training environment free of acute stress. This type of training environment is incongruent with human hormonal fear responses that would be present during a real knife attack. The result is training that is not realistic.

According to Cannon, J. A. & Salas, E. (1998), *Making Decisions Under Stress*, In Driskell, James E. & Johnston, Joan H. *Stress Exposure Training* (pp. 193) Washington, D.C.: American Psychological Association, "Research has shown that, for some tasks normal training procedures (training conducted under normal, non-stress conditions) often do not improve task performance when the task was to be performed under stress conditions (Zakay & Wooler, 1984). These results suggest that, under certain conditions, the transfer of training from classroom conditions to operational conditions may be poor when there are no stress-inclusive simulations or training."

To address the deficiencies noted above, a knife shaped electric shocking device was described by Jeffrey James Quail in U.S. Pat. No. 7,353,984. The knife shaped electric shocking device disclosed addressed some of the deficiencies of the prior art by having a training knife that delivered an electrical discharge when the blade touched the student. This electrical discharge caused a safe pain stimulus that elevated the stress of the student and provided a realistic training environment. Although the device described in U.S. Pat. No. 7,353,984 includes a flexible blade to minimize injury when in contact with a trainee, the blade is much more suited for use in a slicing motion, and is not particularly well suited for simulating a stabbing motion.

SUMMARY OF THE INVENTION

According to a first aspect of the invention there is provided an electrical shocking training device comprising:

a handle body which is elongate in a longitudinal direction between a first end and a second end and which is suitably sized so as to be adapted to be gripped in a hand of a person;

an outer end face of non-conductive material supported at the first end of the handle body which is oriented transversely to the longitudinal direction of the handle body;

a first contact and a second contact supported in the outer end face at spaced apart positions;

each of the first contact and the second contact having an outermost surface which is transverse to the longitudinal direction and in close proximity to the outer end face of non-conductive material so as to be non-penetrating; and a voltage source having opposed terminals arranged for connection to the first and second contacts respectively and for delivering a non-incapacitating electrical shock to a person in proximity to the first and second contacts.

This new design provides an advantage for durability, manufacturing and safety. The device is designed to be used primarily as a training edged weapon to train specifically for a stabbing attack. A stabbing attack is described as a thrusting action in which the tip of the simulated blade is thrust against the body of the individual being trained. If the appropriate amount of thrust is used during the training attack, a safe and localized electrical shock will be delivered to the student.

The primary difference between this new device and prior art devices such as the device described in U.S. Pat. No. 7,353,984, is that the electrodes are placed on the hilt or handle portion of the training knife as opposed to the blade itself.

The difference between the new training knife and a stun gun, is a stun gun is not designed to be thrust into a body without causing injury. In some embodiments described in the following, the device offers protection from impact by using a spring loaded recessing blade which will absorb impact or by utilizing a compressing foam. It is also designed to give the appearance of an edged weapon in some configurations.

Preferably each of the first and second contacts protrudes from the outer end face by a height which is less than a lateral dimension of the contact transverse to the longitudinal direction.

Preferably the device further includes a guard body formed of a resilient material supported on the first end of the handle body which defines the outer end face of non-conductive material. Preferably the resilient material of the guard body is more resilient than a material of the handle body. The guard body may have a greater width than the handle body in a lateral direction transverse to the longitudinal direction.

According to some embodiments, a blade body may be supported at the first end of the handle body so as to be movable between first position in which a free outermost end of the blade body protrudes longitudinal outward from the handle body beyond the first and second contacts and a second position in which the free outermost end of the blade body is recessed inwardly towards the handle body relative to the first position. Preferably the blade body being biased towards the first position.

Each of the first and second contacts includes a respective annular flange portion which overlaps the outer end face of non-conductive material.

An outer side of each of the first and second contacts may be generally rounded or convex.

Each of the first and second contacts may comprise a fastener securing the outer end face of non-conductive material to the first end of the handle body.

According to a first embodiment, the blade body may be linearly slidable relative to the handle body between the first position in which the blade body extends longitudinally outward from the handle body and the second position in which the blade body is received within a hollow cavity within the handle body. In this instance a spring may be supported in the hollow cavity within the handle body so as to bias the blade body towards the first position.

According to a second embodiment, the blade body may be a compressible material so as to be movable from the first position in which the blade body is substantially uncompressed so as to extend longitudinally outward from the handle body beyond the first and second contacts to the second position in which the blade body is compressed such that the blade body does not protrude longitudinally outward from the outer end face of the handle body beyond the first and second contact.

According to a third embodiment in which the handle body takes the form of an existing stun gun, the training device may be further arranged such that:

i) a guard body is supported on the first end of the handle body so as to define the outer end face of non-conductive material supporting the first and second contacts therein;

ii) the guard body is readily separable from the handle body;

iii) the handle body comprises a first end face at the first end thereof which supports a first conductive post and a second conductive post which protrude longitudinally outward from the first end face and which are connected to the opposed terminals of the voltage source for delivering an electrical shock to a person in proximity to the first and second posts when the guard body is removed from the handle body;

iv) the first and second contacts supported on the guard body are coupled to the opposed terminals of the voltage source through the first and second conductive posts; and v) the first and second contacts being readily separable from the first and second conductive posts together with separation of the guard body from the handle body.

In this instance, the guard body preferably fully spans the first end face of the handle body when supported on the handle body.

According to a second aspect of the present invention there is provided an electrical shocking training device comprising:

a handle body which is elongate in a longitudinal direction between a first end and a second end and which is suitably sized so as to be adapted to be gripped in a hand of a person;

an outer end face of non-conductive material supported at the first end of the handle body which is oriented transversely to the longitudinal direction of the handle body;

a first contact and a second contact supported in the outer end face at spaced apart positions;

a voltage source having opposed terminals in connection with the first and second contacts respectively for delivering an electrical shock to a person in proximity to the first and second contacts; and a blade body supported at the first end of the handle body so as to be movable between first position in which a free outermost end of the blade body protrudes longitudinal outward from the handle body beyond the first and second contacts and a second position in which the free outermost end of the blade body is recessed inwardly towards the handle body relative to the first position;

the blade body being biased towards the first position.

According to a third aspect of the present invention there is provided a training device for use with a stun gun in which the stun gun includes i) a handle body which is elongate in a longitudinal direction between a first end and a second end and which is suitably sized for gripping in a hand of a person, ii) a first conductive post and a second conductive post supported at spaced apart positions on the first end of the handle body so as to protrude longitudinally outward from the first end of the handle body, and iii) a voltage source having opposed terminals connected to the first and second conductive posts respectively for delivering an electrical shock to a person in proximity to the first and second conductive posts, the training device comprising:

a guard body of non-conductive material adapted to be supported on the first end of the handle body so as to cover the first and second conductive posts and so as to be readily removable from the handle body;

a first contact and a second contact supported in an outer end face of the guard body at spaced apart positions;

the first and second contacts being coupled to the opposed terminals of the voltage source through connection to the first and second conductive posts respectively so as to be arranged to deliver an electrical shock to a person in proximity to the first and second contacts when the guard body is supported on the first end of the handle body; and the first and second contacts being readily separable from the first and second conductive posts together with separation of the guard body from the handle body.

Preferably the guard body is formed of a resilient material which is more resilient than a material of the handle body.

Preferably the guard body has a greater width than the handle body in a lateral direction transverse to the longitudinal direction. More particularly, in the illustrated embodiment the guard body fully spans the first end face of the handle body when supported on the handle body.

Preferably each of the first and second contacts protrudes from the outer end face of the guard body by a height which is less than a lateral dimension of the contact transverse to the longitudinal direction.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
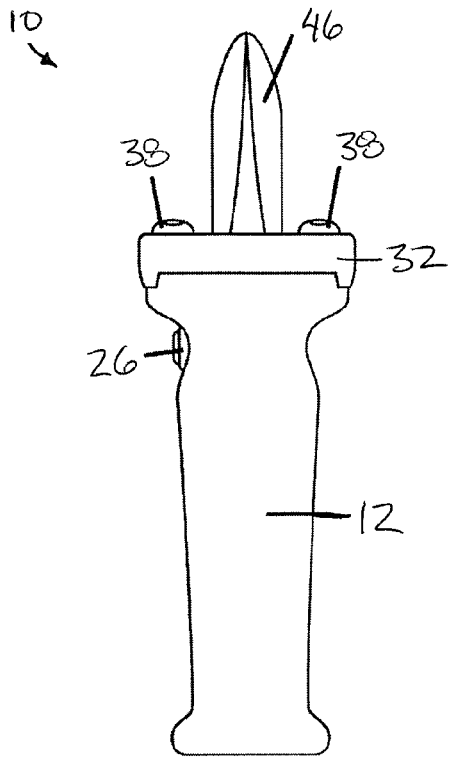
FIG. 1 is a front view of a first embodiment of the training device, in an extended position.
Figure 2:
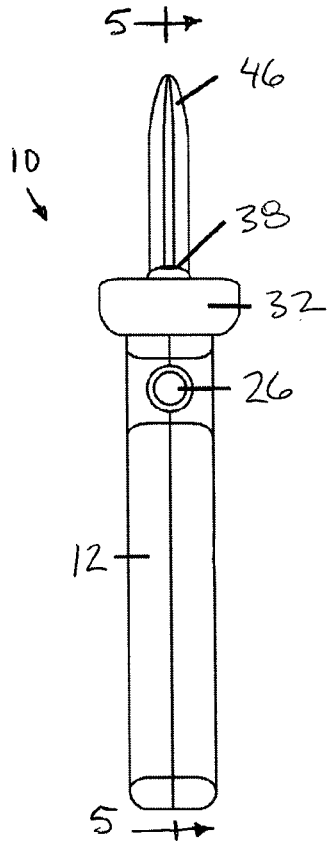
FIG. 2 is a side view of the training device according to the first embodiment of FIG. 1.
Figure 3:
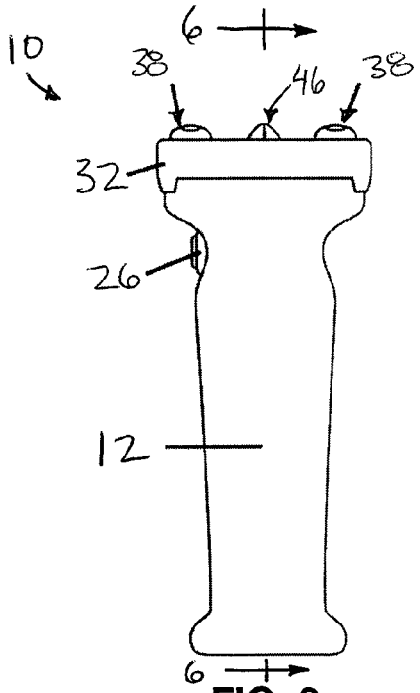
FIG. 3 is a front view of the training device according to the first embodiment of FIG. 1, in a retracted position.
Figure 4:
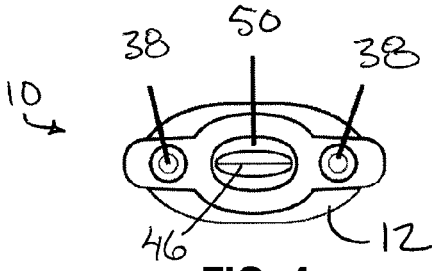
FIG. 4 is a top plan view of the training device according to the first embodiment of FIG. 1.

Referring to the accompanying figures, there is illustrated a training device generally indicated reference numeral 10. The training device 10 is suited for gripping in the hand of a person for delivering an electrical shock or electrical discharge when thrust against a trainee in a simulated stabbing motion. Various embodiments of the training device are shown in the accompanying figures; however, the common features of the various embodiments will first be described herein.

The training device 10 includes a handle body 12 formed of rigid material, for example metal, composite materials, or a molded polycarbonate material. The body 12 is elongate in a longitudinal direction between a first end 14 and a second end 16. The length of the body and the overall circumference along the length thereof between the first and second ends is suitably sized for gripping in a single hand of a user.

The rigid body 12 is a hollow housing formed of two molded casing portions, each spanning the length of the body and defining approximately half of the circumference of the body. The two casing portions are joined together to define a hollow chamber 18 within the interior of the handle body which is fully enclosed.

The hollow chamber 18 houses various operating electronics therein including a printed circuit board which defines a voltage controller 20 and a power source in the form of a battery 22. The battery 22 supplies electrical power to the controller which in turn regulates the voltage being delivered to two opposed terminals 24 of the circuit board. The regulated voltage at the opposed terminals 24 is communicated to external components described below for delivering an electrical discharge to the trainee at the regulated voltage. The voltage is typically regulated to a level which delivers a painful momentary shock to the user but which is typically non-incapacitating.

Typically each of the handle bodies is provided with a charging port 25 in the second end of the handle body which permits connection to a suitable charger which can be plugged into an electrical outlet for supplying electrical power to recharge the battery as required.

A switch 26 is provided externally on the handle body which is electrically connected to the controller 20. The switch comprises a push-button switch located in a side wall of the handle body at a location which is nearer to the first end than the second end so as to be well oriented for being contacted by a thumb of a user gripping the handle body in their fist. When the switch is depressed, the controller is activated such that an active voltage is applied to the opposed terminals 24 ready for discharging an electrical shock to a trainee as further described below.

The regulated voltage of the controller can be adjusted in magnitude by optionally providing a level adjustment switch or activation button on an exterior surface of the handle body, typically at the second end face thereof. Operating the external switch or button would in turn change the prescribed voltage which is regulated for delivery to the opposed terminals for subsequent electrical discharge to a trainee during use.

The handle body 12 includes a first end face 28 at the first end thereof which is generally perpendicular to the longitudinal direction of the elongate handle body. Two conductive elements 30 are supported at the first end face 28 at spaced apart locations in electrical isolation from one another. The two conductive elements 30 are coupled to the two opposing terminals 24 of the controller respectively using respective electrical leads connected therebetween in parallel.

The device 10 further includes a guard body 32 formed of a resilient, non-conductive material, for example rubber, which is more resilient than the material of the handle body. The guard body 32 is suitably sized to fully span the first end face 28 at the first end of the handle body 12 by being wider than the handle body in a lateral direction that is perpendicular to the longitudinal direction of the handle. The guard body 32 includes a depending portion 34 in the form of a peripheral lip which overlaps the peripheral edge of the first end face and part of the side surface of the handle body. The guard body of resilient material serves to protect a trainee from injury when the rigid handle body is thrust towards the trainee in a simulated stabbing motion.

An outer end face 36 of the guard body 32 is generally flat and oriented perpendicularly to the longitudinal direction of the handle body. First and second contacts 38 are mounted in the outer end face 36 of the guard body at laterally spaced positions so as to be electrically isolated from one another. The first and second contacts 38 are electrically connected to the conductive elements 30 respectively in parallel with one another using suitable conducive leads. Accordingly, the first and second contacts are effectively connected in parallel to the opposed terminals 24 of the controller 20 by connection through the conductive elements 30 at the first end face of the handle body.

Each contact 38 has an outermost surface 40 which is generally flat and perpendicular to the longitudinal direction of the handle body. The diameter of the outermost surface 40 is greater than a height or longitudinal distance of the outermost surface from the outer end face 36 of the guard body so as to be in close proximity to the outer end face in a low profile and non-penetrating configuration.

The discharge delivering outermost surface 40 of each contact is supported within a surrounding supporting body of rigid material which defines an annular flange portion 42 surrounding the outermost surface 40 of the contact. The outermost surface 40 is substantially flush at the outer side with the surrounding annular flange portion 42.

Each contact further includes a conductive stem 44 extending longitudinally through a respective bore in the guard body for communication between the outermost conductive surface 40 at the outer end to the respective one of the conductive elements 30 at the first end of the handle body at the inner end. The annular flange portion 42 is larger in diameter than the stem 44 so as to be arranged to overlap in a lateral direction over a portion of the outer end face of the guard body 32.

Turning now more particularly to the first embodiment shown in FIGS. 1 through 9, the training device in this instance further includes a blade body 46 which is generally in the shape of the blade of a knife. More particularly, the blade body comprises two diametrically opposed knife edges extending generally parallel to one another in the longitudinal direction of the handle body towards an outermost free end 48 of the blade body. The outer free end is rounded and the diametrically opposed knife edges are similarly dull to prevent penetration or cutting of the trainee in use.

According to the first embodiment, the blade body is formed of a rigid, plastic or composite material. An inner end of the blade body is supported for linear sliding in the longitudinal direction relative to the handle body. To accommodate the sliding of the blade body, the handle body in this instance includes a blade cavity 50 in the form of an elongate cavity open to the first end face of the handle body and being suitably sized to fit the majority of the blade body 46 therein.

A perimeter retainer flange 52 at the open end of the cavity extends inward to a central opening sized to only receive the main body portion of the blade body 46 longitudinally slidable therethrough. An inner end of the blade body is provided with a base flange 54 which has a lateral dimension that is greater than the central opening at the first end of the handle body and that is greater the main portion of the blade body 46, but which still fits within the larger dimensions of the cavity. The base flange 54 is thus slidable within the cavity but is restricted from removal from the cavity. In this manner, the blade body is restricted to a linear sliding movement between a first extended position and a second retracted position.

In the first extended position, the base flange 54 is abutted against the inner side of the retainer flange 52 such that the majority of the blade body protrudes longitudinally outward from the first end of the handle body beyond the outermost conductive surfaces 40 of the contacts 38.

The blade body is retractable from the first position to the second position in which the outer free end 48 of the blade body is retracted inwardly towards the handle body relative to the second position to an overall height from the first end of the handle body which is near to or slightly less than the height of the outermost conductive surfaces 40 of the contacts in the longitudinal direction from the first end of the handle body. The blade body thus does not obstruct contact of the contacts 38 with a trainee in the retracted second position.

A spring 56 is mounted internally within the cavity between the inner end of the blade body and an internal terminal end of the cavity. The spring is compressed as the blade body is slidably displaced from the first extended position to the second retracted position so as to bias the blade body back to the first position.

In order to make space for the cavity which receives the retracted blade body therein, the hollow chamber within the handle body which receives the electronics therein is mounted nearer to the second end of the body in this instance.

Also shown in the first embodiment, the stems 44 of the contacts 38 comprise rigid posts which can be positively connected to the first end of the handle body to function as fasteners which selectively retain a guard body against the first end face of the handle body. The stems 44 in this instance may be threaded into respective threaded bores in the handle body to assist in retaining the guard body against the first end face of the handle body.

Also shown in the first embodiment of FIG. 1, the outermost conductive surface of each contact and the respective annular flange portion 42 are domed or convex in profile to further ensure that they are non-penetrating relative to a trainee interacting with the training device.

Turning now to a second embodiment shown in FIGS. 10 through 16, a blade body 46 is again provided in this instance so as to again be movable between a first position in which the outermost free end 48 protrudes longitudinally outward from the handle body beyond the first and second contacts, and a second position in which the outermost free end 48 of the blade body is recessed inwardly towards the handle body relative to the first position. In this instance however, the blade body 46 comprises a compressible foam material which is in an uncompressed condition in the first position. The outer free end 48 is retracted from the first position to the second position by compressing the material of the blade body to a resulting height in the longitudinal direction from the first end of the handle body which is near to or less than the corresponding height of the contacts.

The blade body in this instance has a main body portion 60 defining the majority of the length of the blade body. The blade body has a rounded, domed, or convex shape at the outermost free end 48 thereof. The main body portion 60 is generally circular in cross section perpendicular to the longitudinal direction of the handle. The blade body 46 in this instance further includes a flange portion 62 at the inner end of the main body 60 which is generally annular about the main body and protrudes radially outward to have a greater overall diameter.

The guard body in this instance serves to clamp the flange portion 62 of the blade body against the first end of the handle body by providing a first central bore 64 in the guard body having dimensions which correspond to the main body portion of the blade body received therethrough. A second counter-bore 66 is provided at the inner side of the guard body which is larger in diameter than the first bore to correspond to the dimensions of the flange portion 62 at the inner end of the blade body. Accordingly, when the guard body is mounted against the first end of the handle body, the flange portion of the blade body is effectively retained by the mating arrangement of the main body portion and flange portion with the first bore 64 and the second counter-bore 66 in the guard body. No cavity is required at the first end of the handle body in this instance as the blade body is sufficiently compressible to be compressed against the first end face of the handle body in the second position.

The contacts 38, and their manner of connection to the handle body to retain the guard body against the first end face of the handle body in the assembled configuration in the second embodiment, are substantially identical to the contacts described above with regard to the first embodiment.

Turning now to the third embodiment of FIGS. 17 through 22, the handle body in this instance comprises a conventional stun gun of specified configuration. The guard body in this instance provides an attachment device which when assembled onto the stun gun defines the overall training device 10. The guard body is mounted in a removable manner so as to permit use of the stun gun as a training device when the guard body is mounted thereon, or permit the stun gun to be used in a conventional manner by removing the guard body.

When the handle body 12 comprises a stun gun, the two conductive elements 30 at the first end face thereof comprise the conductive posts which protrude longitudinally outward from the first end face so as to be suited for penetration through clothing of a targeted individual to be incapacitated with the stun gun during conventional stun gun use.

The guard body 32 in this instance comprises an inner cavity 70 at the inner end thereof which receives the first end of the handle body inserted therein in the mounted position. Two bores 72 are formed in the inner end face of the cavity 70 for alignment with the two conductive posts 30 of the handle body. Two connectors 74 are mounted at the inner ends of the bores 72. The connectors 74 are conductive and are arranged for making a suitable electrical connection to the conductive elements 30 or posts of the handle body of the stun gun. Suitable lead wires form an electrical connection between the two connectors 74 and the first and second contacts 38 at the outer end face of the guard body such that the first and second contacts in the guard body are again connected in parallel with one another to respective ones of the opposed terminals of the controller which functions as the voltage source.

The outer conductive surfaces 40 of the contacts are again received within respective supporting bodies 42 defining annular flanges about each contact, however, the annular flanges 42 are partially recessed into the outer end face of the guard body in this instance to further reduce the profile of the contacts protruding longitudinally outward from the outer end face of the guard body. The activation switch 26 of the stun gun is again used for activation during use similar to the embodiments noted above.

The guard body 32 is held onto the handle body 12 in this instance using a strap member 76 which is secured as a continuous loop about the handle body and the guard body in the longitudinal direction. More particularly the strap member is received within a corresponding groove 78 which extends across the outer end face 36 of the guard body so as to be flush at the outer side of the strap with the outer end face 36. The strap can be separated, for example using Velcro™ and the like, which in turn permits the guard body 32 to be longitudinally slidably removable from the first end of the handle body 12.

In summary of the above description, the first embodiment utilizes a recessing training blade. In this instance a safe, composite blade protrudes from the handle of the training knife. The blade is designed to recess into the handle of the training knife when pressure is applied to the tip of the blade, typically through a thrusting action against the body. The blade recesses into the handle, pushing against a spring or other resiliently resistant device. Once the blade, is fully recessed into the handle, the electrodes on the hilt will make contact with the student's body allowing a shock to be delivered. This will simulate the pain of being stabbed.

The second embodiment uses a shorter foam blade that sits atop of the handle in the middle of the hilt. When the training knife is thrust into the body of a student, the foam blade will compress or bend allowing the electrodes on the hilt to make contact with the student's body. Once contact with the electrodes are made, a safe, localized electrical shock will be delivered into the body.

The third embodiment uses a conversion kit that will convert a standard stun gun into a device that can be safely used to stab against the body for training purposes. In this embodiment, the device is fitted over the electrodes of a stun gun. The device is manufactured from a high density foam that protects anyone from impact injury by covering the hard plastic and pointy metal electrodes of the stun gun. The device has rounded electrodes at the top that conduct the electricity from the stun gun electrodes. When these electrodes are thrust against the student's body, it delivers the electric shock from the stun gun.

FIGS. 1 to 4 show the front views of the device with the recessed blade embodiment, with both blade extended and blade retracted as well as side and top views of the device. The device case consists of two mirror image composite casings and which are glued together to form a hard handle. The rubber safety hilt is constructed of a compressible rubber and assists in absorbing any impact. The composite blade is designed to have a rounded end to ensure that it does not penetrate the skin. The two electrodes and are made of a rounded metal to insure they do not cause injury. The on/off button of the device is shown on the left hand side and when depressed, allows electricity to flow to the electrodes.

Figure 5:
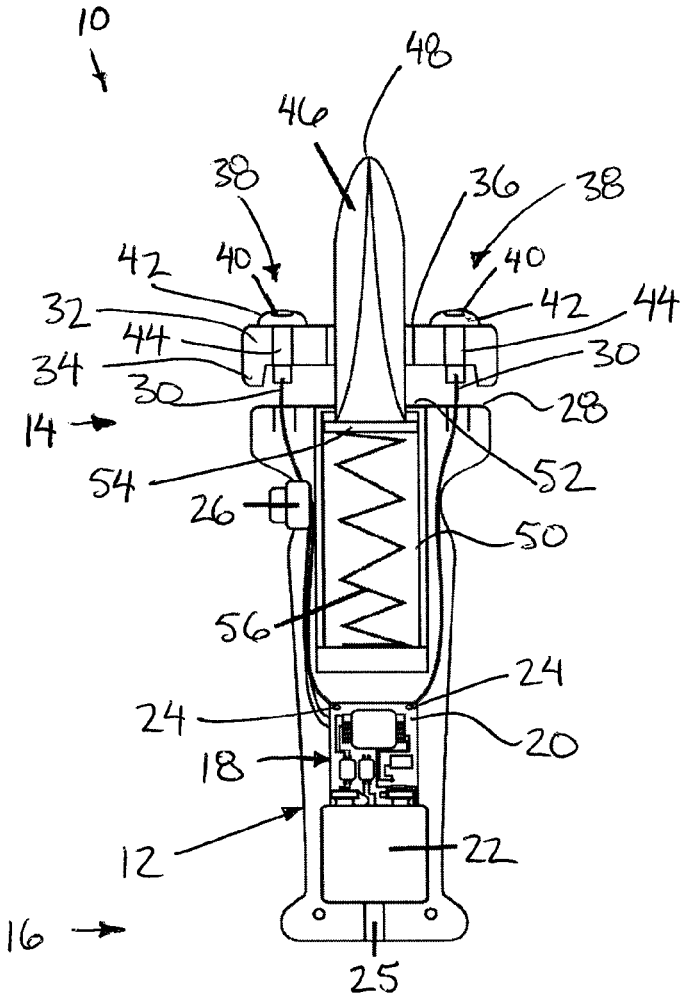
FIG. 5 is a sectional view along the line 5-5 of FIG. 2.
Figure 6:
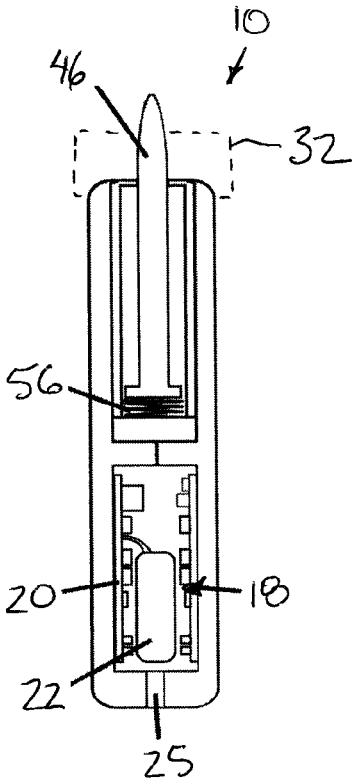
FIG. 6 is a sectional view along the line 6-6 of FIG. 3.

FIGS. 5 and 6 show cutaway front and side views of the device with the recessed blade embodiment. The view from the front shows a cutaway of the recessed blade in the extended position. The case shows the compartment that houses the spring and composite blade. It shows the safety hilt removed from the top of the casing. The safety hilt, is typically held onto the top of the casing and by glue and the electrodes and pushing through the holes in the safety hilt are secured to the casing which assists in holding it in place. Leads run from both electrodes and to the circuit board and. These wires conduct a current from the circuit board and. The side view shows the composite blade with the spring in the retracted position.

Figure 7:
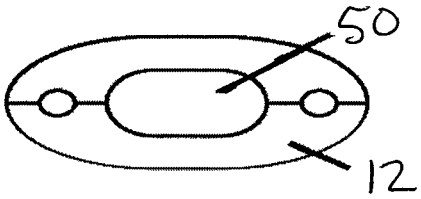
FIG. 7 a top plan view of the handle body of the training device according to the first embodiment of FIG. 1.
Figure 8:
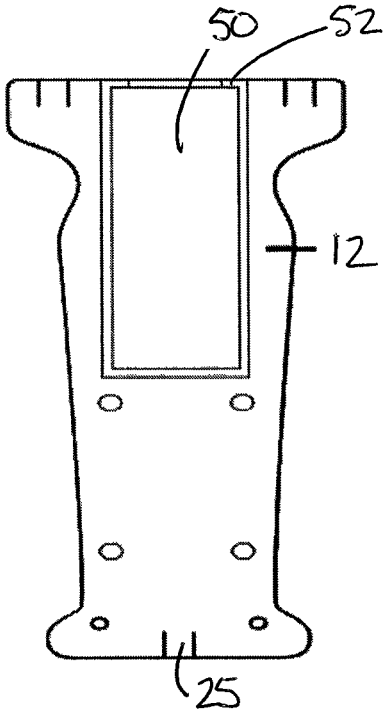
FIG. 8 is a sectional view of the handle body of the training device along the line 5-5 of FIG. 2.
Figure 9:
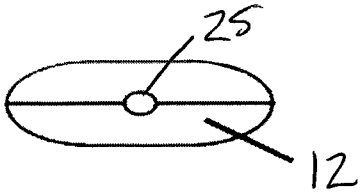
FIG. 9 is a bottom plan view of the handle body of the training device according to the first embodiment of FIG. 1.

FIGS. 7, 8 and 9 show the top, inside, and bottom of the case for the recessed blade embodiment. The top view exposes the opening for the composite blade.

Figure 10:
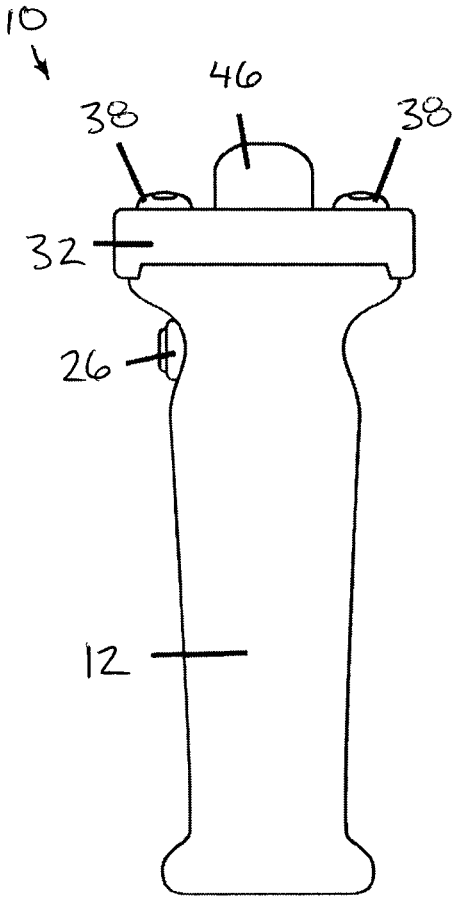
FIG. 10 is a front view of a second embodiment of the training device, in an compressed position.
Figure 11:
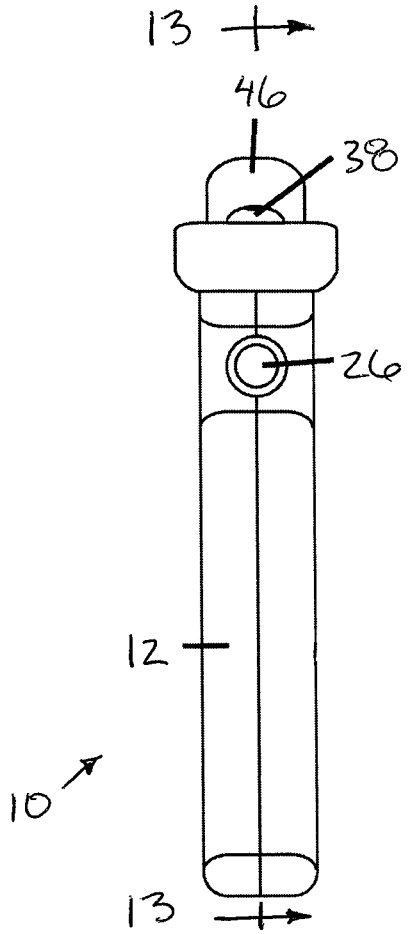
FIG. 11 is a side view of the training device according to the second embodiment of FIG. 10.
Figure 12:
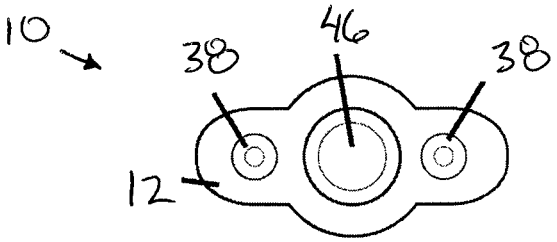
FIG. 12 is a top plan view of the training device according to the second embodiment of FIG. 10.

FIGS. 10, 11 and 12 show front, side and top views of the device with the foam blade embodiment. The foam blade is made of a compressible material so that when it is compressed the electrodes and will make contact with whatever compresses the foam blade. The rubber safety hilt is constructed of a compressible rubber and assists in absorbing any impact. The foam blade is designed to have a rounded end to ensure that it does not penetrate the skin. The two electrodes and are made of a rounded metal to insure they do not cause injury. The on/off button of the device is shown on the left hand side and when depressed, allows electricity to flow to the electrodes.

Figure 13:
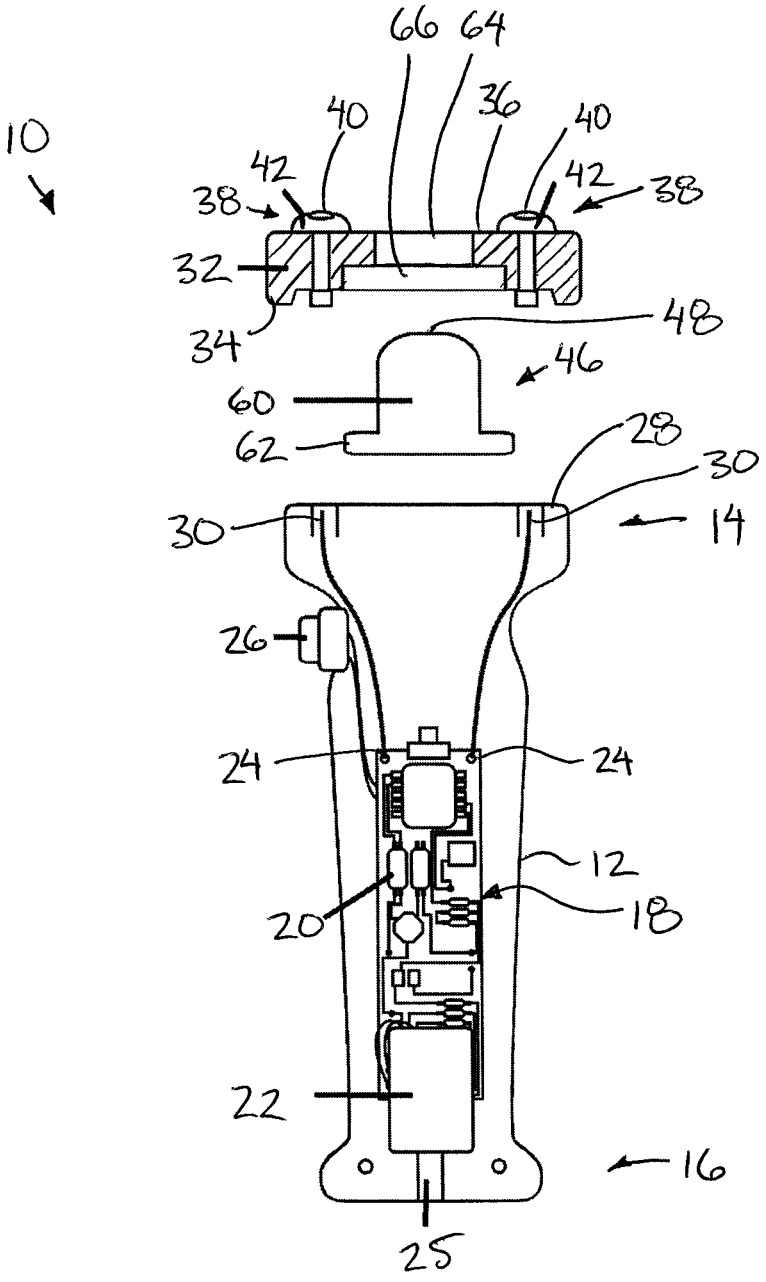
FIG. 13 is an exploded sectional view along the line 13-13 of FIG. 11.

FIG. 13 shows a cut away view of the case and an exploded view of the top of the foam blade embodiment. The foam blade is shown to fit underneath the rubber safety hilt. The safety hilt, is typically held onto the top of the casing and by glue and the electrodes and pushing through the holes in the safety hilt are secured to the casing which assists in holding it in place. Leads run from both electrodes and to the circuit board. These wires conduct a current from the circuit board and.

Figure 14:
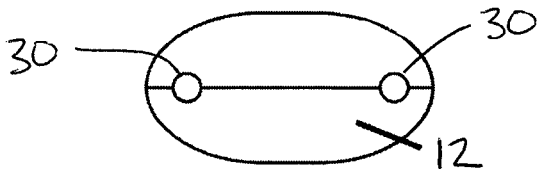
FIG. 14 is a top plan view of the handle body of the training device according to the second embodiment of FIG. 10.
Figure 15:
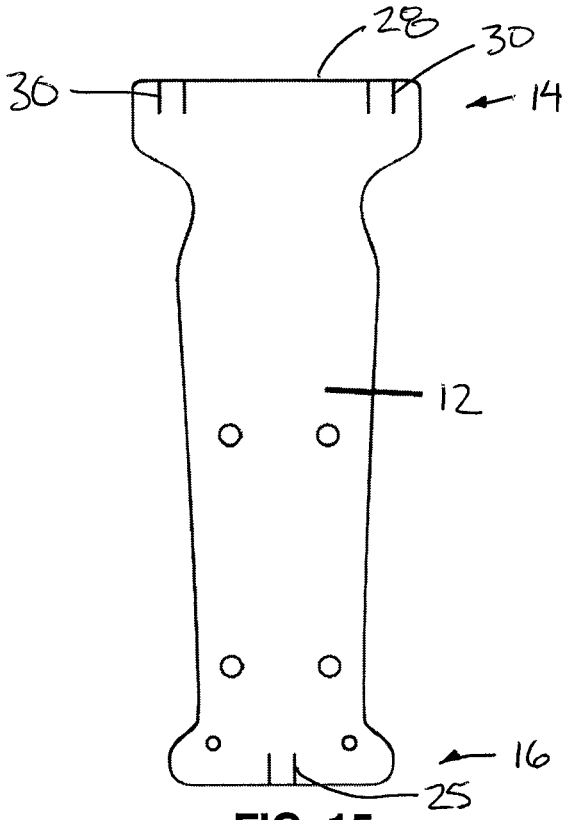
FIG. 15 is a front view of the handle body of the training device according to the second embodiment of FIG. 10.
Figure 16:
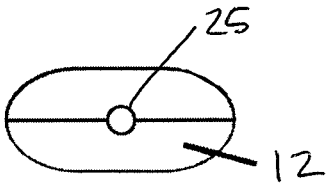
FIG. 16 is a bottom plan view of the handle body of the training device according to the second embodiment of FIG. 10.
Figure 17:
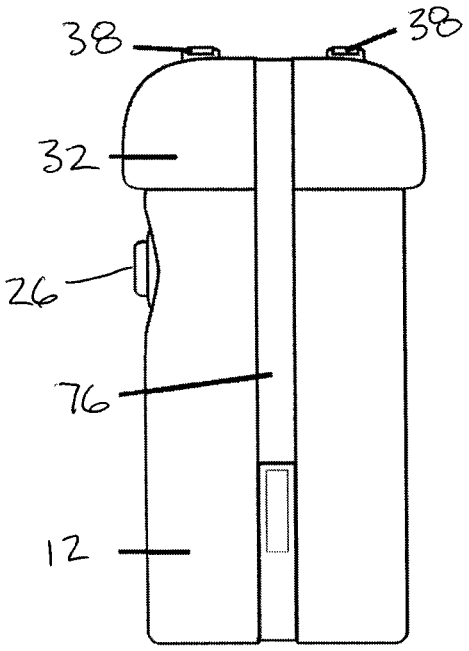
FIG. 17 is a front view of a third embodiment of the training device.
Figure 18:
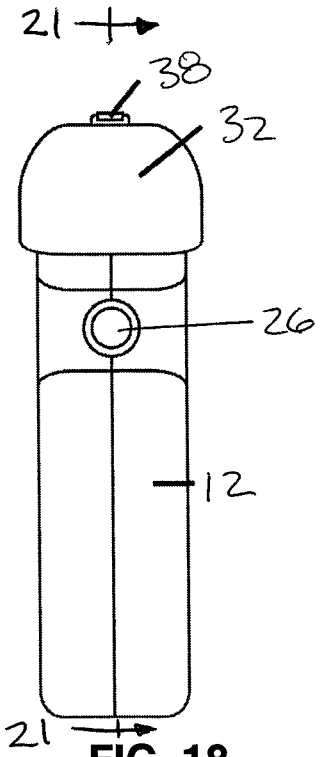
FIG. 18 is a side view of the training device according to the third embodiment of FIG. 17.
Figure 19:
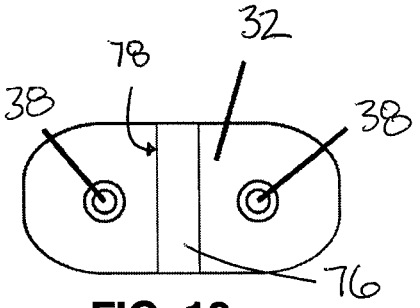
FIG. 19 is a top plan view of the training device according to the third embodiment of FIG. 17.
Figure 20:
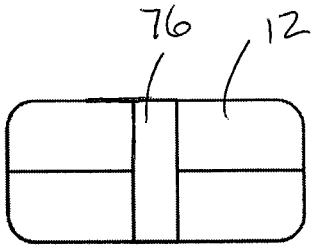
FIG. 20 is a bottom plan view of the training device according to the third embodiment of FIG. 17.

FIGS. 14, 15 and 16 show the top, inside and bottom of the case for the foam blade embodiment. Unlike the recessed blade embodiment, there is not a hole in the top of the casing and, as the foam blade does not recess.

FIGS. 17, 18, 19 and 20 show the front, side, top and bottom views of the stun gun conversion device embodiment, affixed to a sample stun gun. The foam cover slides on top of the end of the stun gun that the electrodes protrude from. The foam cover exposes two rounded metal electrodes and at the top. A fastener affixes the conversion device to the top of the stun gun.

Figure 21:
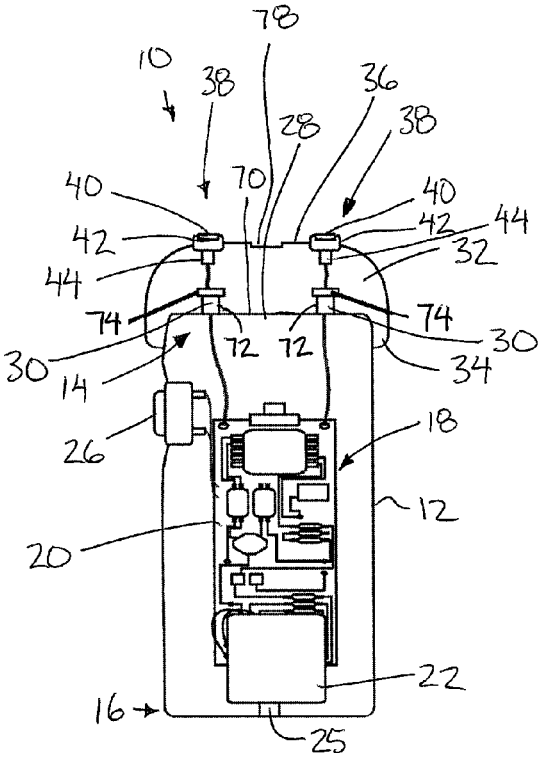
FIG. 21 is a sectional view along the line 21-21 of FIG. 18.

FIG. 21 shows a cutaway view from the front view of the stun gun conversion device embodiment, affixed to a sample stun gun. The cutaway shows how the conducting posts and make contact with the two electrodes exposed from the stun gun. The conducting posts are made of metal and connected by wire to the two exposed electrodes and of the foam cover. This allows the electrical shock from the stun gun to be conducted to the electrodes and of the conversion device.

Figure 22:
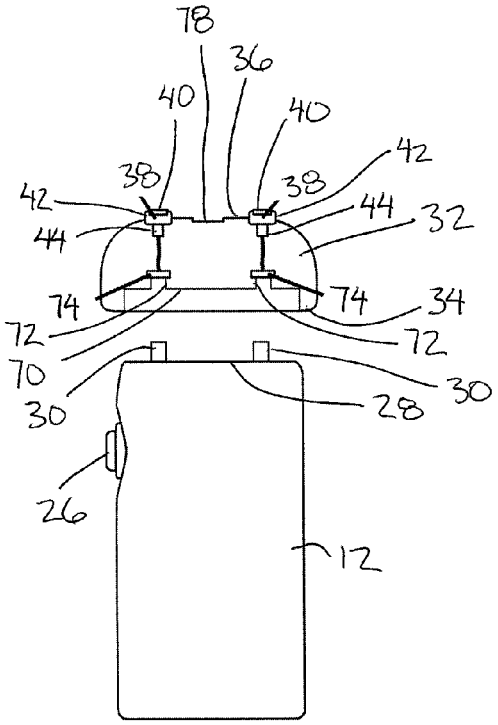
FIG. 22 is an exploded, partly sectional front view of the training device according to the third embodiment of FIG. 10.

FIG. 22 shows a cutaway view from the front view of the stun gun conversion device embodiment, removed from the stun gun.

Operation for first and second embodiment generally begins with the training knife being plugged into a charging device to ensure the battery is charged for use. Once charged, the knife is turned on by pressing and holding the on button. Once on, electricity from the battery flows into the circuit board which amplifies the voltage and stores an electrical charge. The user then selects what level of pain penalty they desire for training by pressing the shock adjustment button either up or down. The training knife is now in a ready state for training.

The trainer holds the knife handle with their hand and will attack the student with a stabbing or thrusting type of attack. The student will practice their self-defense techniques. Each time the blade is successfully thrust against the body of the student, the student will receive a safe, localized electrical shock.

When utilizing the recessing training blade embodiment, each time the training knife is thrust against the body of the student, the blade will recess into the handle of the training knife. When the blade recesses all the way down, the electrodes on the hilt will make contact with the body and deliver an electrical discharge. Then the spring will push the blade back to the extended position when it is pulled away from the student's body.

When using the foam blade embodiment, the foam blade sits atop of the handle in the middle of the hilt. When the training knife is thrust into the body of a student, the foam blade will compress or bend allowing the electrodes on the hilt to make contact with the student's body. Once contact with the electrodes are made, a safe, localized electrical shock will be delivered into the body. When the device is pulled away from the body, the foam will expand back to its original size. When using the safety conversion kit for a specified stun gun, the device will be slid over the top of the stun gun, covering the electrodes with the foam protection. The internal conducting points will make contact with the electrodes of the stun gun. When the stun gun is turned to the on position, the electricity flowing to the stun gun electrodes will travel into the internal conducting points, which in turn will allow the electricity to travel out the external electrodes of the training device. When the user thrusts the device against the body of the student, a shock will travel through the skin between the two electrodes.

In alternative embodiments, the components of the device may be made with different materials, sizes and textures.

A counting device can be used to count how many times contact is made with the student. This count can be monitored on the device or remotely to another location.

An audio sound can be emitted each time contact is made with the body.

The electrical components can be mounted into the recessing blade to free up room within the knife handle.

Since various modifications can be made in my invention as herein above described, it is intended that all matter contained in the accompanying specification shall be interpreted as illustrative only and not in a limiting sense.

The invention claimed is:

1. An electrical shocking training device comprising:

a handle body which is elongate in a longitudinal direction between a first end and a second end and which is suitably sized so as to be adapted to be gripped in a hand of a person;

an outer end face of non-conductive material supported at the first end of the handle body which is oriented transversely to the longitudinal direction of the handle body;

a first contact and a second contact supported in the outer end face at spaced apart positions;

each of the first contact and the second contact having an outermost surface which is transverse to the longitudinal direction and in close proximity to the outer end face of non-conductive material so as to be non-penetrating; and a voltage source having opposed terminals arranged for connection to the first and second contacts respectively and for delivering a non-incapacitating electrical shock to a person in proximity to the first and second contacts.

2. The device according to claim 1 wherein each of the first and second contacts protrudes from the outer end face by a height which is less than a lateral dimension of the contact transverse to the longitudinal direction.

3. The device according to claim 1 further comprising a guard body supported on the first end of the handle body and defining the outer end face of non-conductive material, the guard body being formed of a resilient material.

4. The device according to claim 3 wherein the resilient material of the guard body is more resilient than a material of the handle body.

5. The device according to claim 3 wherein the guard body has a greater width than the handle body in a lateral direction transverse to the longitudinal direction.

6. The device according to claim 1 wherein each of the first and second contacts includes an annular flange portion which overlaps the outer end face of non-conductive material.

7. The device according to claim 1 wherein an outer side of each of the first and second contacts is generally convex.

8. The device according to claim 1 wherein each of the first and second contacts comprises a fastener securing the outer end face of non-conductive material to the first end of the handle body.

9. The device according to claim 1 further comprising a blade body supported at the first end of the handle body so as to be movable between first position in which a free outermost end of the blade body protrudes longitudinal outward from the handle body beyond the first and second contacts and a second position in which the free outermost end of the blade body is recessed inwardly towards the handle body relative to the first position, the blade body being biased towards the first position.

10. The device according to claim 9 wherein the blade body is linearly slidable relative to the handle body between the first position in which the blade body extends longitudinally outward from the handle body and the second position in which the blade body is received within a hollow cavity within the handle body.

11. The device according to claim 10 further comprising a spring supported in the hollow cavity within the handle body so as to bias the blade body towards the first position.

12. The device according to claim 9 wherein the blade body comprises a compressible material so as to be movable from the first position in which the blade body is substantially uncompressed so as to extend longitudinally outward from the handle body beyond the first and second contacts to the second position in which the blade body is compressed such that the blade body does not protrude longitudinally outward from the outer end face of the handle body beyond the first and second contact.

13. The device according to claim 1 further comprising:

a guard body supported on the first end of the handle body and defining the outer end face of non-conductive material supporting the first and second contacts therein;

the guard body being readily separable from the handle body;

the handle body comprising a first end face at the first end thereof which supports a first conductive post and a second conductive post which protrude longitudinally outward from the first end face and which are connected to the opposed terminals of the voltage source for delivering an electrical shock to a person in proximity to the first and second posts when the guard body is removed from the handle body;

the first and second contacts supported on the guard body being coupled to the opposed terminals of the voltage source through the first and second conductive posts; and the first and second contacts being readily separable from the first and second conductive posts together with separation of the guard body from the handle body.

14. The device according to claim 13 wherein the guard body fully spans the first end face of the handle body when supported on the handle body.

15. An electrical shocking training device comprising:

a handle body which is elongate in a longitudinal direction between a first end and a second end and which is suitably sized so as to be adapted to be gripped in a hand of a person;

an outer end face of non-conductive material supported at the first end of the handle body which is oriented transversely to the longitudinal direction of the handle body;

a first contact and a second contact supported in the outer end face at spaced apart positions;

a voltage source having opposed terminals in connection with the first and second contacts respectively for delivering an electrical shock to a person in proximity to the first and second contacts; and a blade body supported at the first end of the handle body so as to be movable between first position in which a free outermost end of the blade body protrudes longitudinal outward from the handle body beyond the first and second contacts and a second position in which the free outermost end of the blade body is recessed inwardly towards the handle body relative to the first position;

the blade body being biased towards the first position.

16. A training device for use with a stun gun in which the stun gun includes i) a handle body which is elongate in a longitudinal direction between a first end and a second end and which is suitably sized for gripping in a hand of a person, ii) a first conductive post and a second conductive post supported at spaced apart positions on the first end of the handle body so as to protrude longitudinally outward from the first end of the handle body, and iii) a voltage source having opposed terminals connected to the first and second conductive posts respectively for delivering an electrical shock to a person in proximity to the first and second conductive posts, the training device comprising:

a guard body of non-conductive material adapted to be supported on the first end of the handle body so as to cover the first and second conductive posts and so as to be readily removable from the handle body;

a first contact and a second contact supported in an outer end face of the guard body at spaced apart positions;

the first and second contacts being coupled to the opposed terminals of the voltage source through connection to the first and second conductive posts respectively so as to be arranged to deliver an electrical shock to a person in proximity to the first and second contacts when the guard body is supported on the first end of the handle body; and the first and second contacts being readily separable from the first and second conductive posts together with separation of the guard body from the handle body.

17. The device according to claim 16 wherein the guard body is formed of a resilient material which is more resilient than a material of the handle body.

18. The device according to claim 16 wherein the guard body has a greater width than the handle body in a lateral direction transverse to the longitudinal direction.

19. The device according to claim 16 wherein the guard body fully spans the first end face of the handle body when supported on the handle body.

20. The device according to claim 16 wherein each of the first and second contacts protrudes from the outer end face of the guard body by a height which is less than a lateral dimension of the contact transverse to the longitudinal direction.

* * * * *